US006454833B1

(12) United States Patent
Nagl et al.

(10) Patent No.: US 6,454,833 B1
(45) Date of Patent: Sep. 24, 2002

(54) PROCESS FOR PRODUCING LIQUID PIG IRON OR SEMIFINISHED STEEL PRODUCTS FROM IRON-CONTAINING MATERIALS

(75) Inventors: Michael Nagl, Reichenau (AT); Johannes-Leopold Schenk, Linz (AT); Werner Leopold Kepplinger, Leonding (AT)

(73) Assignee: Voest-Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/101,176

(22) PCT Filed: Nov. 5, 1997

(86) PCT No.: PCT/AT97/00239

§ 371 (c)(1),
(2), (4) Date: Aug. 13, 1998

(87) PCT Pub. No.: WO98/21371

PCT Pub. Date: May 22, 1998

(30) Foreign Application Priority Data

Nov. 8, 1996 (AT) ..... 1964/96

(51) Int. Cl.[7] ..... C21B 13/00; C22B 5/14

(52) U.S. Cl. ..... 75/448; 75/453; 75/454; 266/172; 266/186

(58) Field of Search ..... 75/444, 448, 447, 75/445, 443, 453, 454; 266/172, 186, 268; 110/204, 216, 182.5

(56) References Cited

U.S. PATENT DOCUMENTS

| | | | | |
|---|---|---|---|---|
| 4,419,965 | A | * | 12/1983 | Garcia-Mallol et al. |
| 4,457,289 | A | * | 7/1984 | Korenberg |
| 4,457,777 | A | * | 7/1984 | MacGregor et al. |
| 4,728,360 | A | * | 3/1988 | Hauk et al. |
| 4,733,619 | A | | 3/1988 | Maeda et al. ..... 110/229 |

(List continued on next page.)

FOREIGN PATENT DOCUMENTS

| | | | |
|---|---|---|---|
| EP | 0010627 | | 5/1980 |
| EP | 0111176 | | 6/1984 |
| EP | 0143102 | | 5/1985 |
| EP | 0193488 | | 9/1986 |
| EP | 0217331 | | 4/1987 |
| EP | 0493752 | | 7/1992 |
| EP | 0576414 | | 12/1993 |
| EP | 0594557 | | 4/1994 |
| JP | 05-009526 | A * | 1/1993 |
| WO | 90/07010 | | 6/1990 |

*Primary Examiner*—Roy King
*Assistant Examiner*—Harry D. Wilkins, III
(74) *Attorney, Agent, or Firm*—Ostrolenk, Faber, Gerb & Soffen, LLP

(57) ABSTRACT

In a method for producing liquid pig iron (9) or steel pre-products from fine-particulate iron-containing material (4) in a melter gasifier (1), the iron-containing material (4) is melted in a bed of solid carbon carriers (2) under supply of carbon-containing material (2) and oxygen-containing gas, at the simultaneous formation of a reducing gas, wherein the fine-particulate reduced material (4) and oxygen are introduced into the bed (20, 21) from the side. To be able to charge the fine-particulate iron-containing material to the melter gasifier (1) without a need for briquetting and, in doing so, avoid discharging of the fine-particulate iron-containing material (4) by the reducing gas formed in the melter gasifier (1), a fluidized bed (21) of fine-particulate solid carbon carriers (2) and fine-particulate iron-containing reduced material (4) is maintained above a fixed bed (20) formed of solid carbon carriers (2) and the fine-particulate reduced material (4) is charged into the fluidized bed (21) directly, in immediate contact with oxygen, preferably in the form of a strand having a ring-shaped cross-section and peripherally surrounding an oxygen jet and enclosing the oxygen, such that the oxygen is enclosed by the supplied fine-particulate reduced material (4), and the fine-particulate reduced material (4) is melted in the fluidized bed (FIG. 1).

11 Claims, 2 Drawing Sheets

U.S. PATENT DOCUMENTS 4,781,574 A * 11/1988 Taylor
4,929,255 A * 5/1990 Hakulin et al.
5,110,323 A * 5/1992 Soni
5,154,732 A * 10/1992 Hakulin et al.
5,445,668 A * 8/1995 Kepplinger et al.
5,534,046 A * 7/1996 Kepplinger et al. ..... 75/446
5,535,991 A * 7/1996 Kepplinger et al. ..... 266/160
5,584,910 A * 12/1996 Kepplinger et al. ..... 75/445
5,746,804 A * 5/1998 Joo et al. ..... 75/387
6,264,725 B1 * 7/2001 Stockinger et al. ..... 75/504

* cited by examiner

PROCESS FOR PRODUCING LIQUID PIG IRON OR SEMIFINISHED STEEL PRODUCTS FROM IRON-CONTAINING MATERIALS

The invention relates to a method for producing liquid pig iron or steel pre-products from fine-particulate iron-containing material, particularly reduced sponge iron, in a melter gasifier in which under supply of carbon-containing material and oxygen at the simultaneous formation of a reducing gas the iron-containing material is melted in a bed formed from solid carbon carriers, optionally upon previous complete reduction, wherein the fine-particulate reduced material and oxygen are introduced into the bed from the side, and to a plant for carrying out the method.

EP-B-0 010 627 teaches a process for the production of liquid pig iron or steel pre-products from particulate iron-containing material, particularly prereduced sponge iron, and for the production of reducing gas in a melter gasifier, wherein by the addition of coal and by blowing in an oxygen-containing gas a fluidized bed is formed of coke particles. Here, the oxygen-containing gas or pure oxygen respectively are injected into the lower region of the melter gasifier. The particulate iron-containing material, particularly prereduced sponge iron, and the lumpy coal are fed in from above, through charging openings arranged in the hood of the melter gasifier, the descending particles are slowed down in the fluidized bed and the iron-containing particles are reduced and melted while falling through the coke fluidized bed. The molten and slag-covered metal collects at the bottom of the melter gasifier. Metal and slag are drawn off through separate tap openings.

A method of this kind is, however, not suited for processing fine-particle sponge iron, as fine-particle sponge iron would be discharged from melter gasifier at once, due to the pronounced upward-oriented gas flow existing within the same. Such a discharge of the fine-particle metal carriers is further favored by the temperature prevailing in the upper region of the melter gasifier, i.e. in the region above the melt-down gasifying zone, which is too low to ensure a melt-down, i.e. agglomeration of the fine particles at the charging site to form bigger particles which in spite of the ascending gas stream could sink down into the melt-down gasifying zone.

From EP-A-0 217 331 it is known to directly prereduce fine ore in a fluidized bed process and to feed the prereduced fine ore to a melter gasifier and to completely reduce it by means of a plasma burner while supplying a carbon-containing reducing agent and to melt it. In the melter gasifier, a fluidized bed forms and thereabove a fluidized bed of coke. The prereduced fine ore or the sponge iron powder respectively are supplied to a plasma burner provided in a lower section of the melter gasifier. One disadvantage here is that by feeding the prereduced fine ore immediately in the lower melting region, i.e. in the region where the melt collects, complete reduction is no longer ensured and the chemical composition required for further processing of the pig iron cannot be achieved in any event. Moreover, charging of substantial amounts of prereduced fine ore is not feasible, due to the fluidized bed or fixed bed respectively forming from coal in the lower region of the melter gasifier, as it is not feasible to discharge a sufficient portion of the melting products from the high-temperature zone of the plasma burner. Charging of more substantial amounts of prereduced fine ore would instantly lead to thermal and mechanical failure of the plasma burner.

From EP-B-0 111 176 it is known to produce sponge iron particles and liquid pig iron from lumpy iron ore, the iron ore being directly reduced in a direct-reduction aggregate and sponge iron particles discharged from the direct-reduction aggregate being separated into a coarse-and fine-grain fraction. The fine-grain fraction is supplied to a melter gasifier, in which the heat required for melting the sponge iron as well as the reducing gas supplied to the direct-reduction aggregate are produced from charged coal and supplied oxygen-containing gas. The fine-grain fraction is conducted into the melter gasifier via a downpipe projecting from the head of the melter gasifier as far as into the vicinity of the fluidized bed of coal. At the end of the downpipe a baffle plate is provided in order to minimize the velocity of the fine-grain fraction, and consequently the exit velocity of the fine-grain fraction on leaving the downpipe is very low. At the charging site, the temperature reigning inside the melter gasifier is very low, as a result of which immediate melting of the supplied fine-grain fraction cannot take place. This and the low exit velocity from the downpipe lead to a substantial portion of the supplied fine-grain fraction exiting from the melter gasifier along with the reducing gas produced in the same. In accordance with this process it is not possible to charge a more substantial amount of fine grain or to charge fine grain exclusively.

In a process according to EP-A-0 576 414 lumpy iron-ore-containing charging substances are directly reduced in a reduction shaft furnace, by means of the reducing gas formed in the meltdown gasifying zone. The sponge iron thus obtained is subsequently fed to the meltdown gasifying zone. In order to be able to additionally utilize fine ore and/or ore dust, such as oxidic iron fine dust incurring in a metallurgical plant, with this known process, the fine ore and/or the ore dust along with solid carbon carriers are supplied to a dust burner working into the meltdown gasifying zone and are reacted in a substoichiometric combustion reaction. A process of this kind enables efficient processing of fine ore and/or ore dust incurring in a metallurgical plant, and that up to an order of magnitude of 20 to 30% of the total ore charge, and thus enables a combined processing of lumpy ore and fine ore. A disadvantage associated with this process is that regions with an excess of metal and regions with an excess of carbon may result in the melt-down gasifying zone.

From EP-A-0 493 752 it is known to separate hot dusts from a gasification reactor, such as a melter gasifier, in a cyclone and in order to surmount a difference of pressure between the cyclone and the gasifier recirculate them via a sluice system, namely via a burner. The known sluice system is very expensive in construction, the mechanically operated sluices being moreover exposed to substantial wear by the dustlike solids.

From EP-A-0 594 557, a method of the initially described kind is known wherein a sponge iron fine grain fraction by means of a conveying gas is charged directly into the fluidized bed formed by the melt-down gasifying zone in the melter gasifier. However, this is disadvantageous; clogging of the fluidized bed may ensue, leading to insufficient gas circulation and optionally to damming-up of gas and subsequently to eruptive outbreaks of gas, by which the clogged fluidized bed is broken up. Hereby, the gasification process for the carbon carriers and also the melt-down process for the reduced iron ore are markedly disturbed.

The invention aims at avoiding these disadvantages and difficulties and has as its object to provide a method of the initially described kind and a plant for carrying out the method, with said method and plant allowing the processing of fine-particulate iron-containing and at least partially reduced material without any need for briquetting and wherein, on the one hand, discharging of the supplied fine particles by the reducing gas generated in the melt-down-gasifying zone is reliably avoided and, on the other hand, the gasification process can proceed untroubled by the fine-particulate reduced material which is being charged. This means that burdening the melt-down gasifying zone with the fine-particulate iron-containing reduced material is to be avoided, even in cases where up to 100% fine-particulate iron-containing reduced material are charged into the melter gasifier.

In accordance with the invention, this object is achieved in that above a fixed bed formed of solid carbon carriers a fluidized bed of fine-particulate solid carbon carriers and fine-particulate iron-containing reduced material is maintained and the fine-particulate reduced material is charged into the fluidized bed directly, in immediate contact with oxygen, preferably in the form of a strand having a ring-shaped cross-section and peripherally surrounding an oxygen jet and enclosing the oxygen, and that the fine-particulate reduced material is melted in the fluidized bed.

According to a preferred embodiment, the fine-particulate reduced material is charged into the fluidized bed by means of a fluidizing gas, preferably by being blown in.

In order to use the center of the fluidized bed as a melting zone as well, oxygen preferably is additionally blown into the fluidized bed (21) in the central region of the same, preferably from above.

It is advantageous, especially when larger amounts/unit of time of fine-particulate reduced material have to be processed, if the fine-particulate reduced material is blown into the fluidized bed under pressure by means of a conveying gas, such that at the outlet into the fluidized bed there forms a hollow space which is free for the fine-particulate reduced material.

To balance a difference in pressure between the feeding of the reduced fine-particulate material and the melt-down gasifying zone, the fine-particulate reduced material prior to being charged into the fluidized bed (21) is suitably collected in a vessel under formation of a fluidized bed and out of the fluidized bed is conveyed onward into the fluidized bed by means of a conveying and/or fluidizing gas. Herein, the fluidized bed forms a sluice maintaining the difference in pressure.

Herein, a conveying gas for the fine-particulate reduced material is suitably fed into the fluidized bed under pressure, preferably at a pressure exceeding the pressure that prevails in the fluidized bed.

A plant for carrying out the method, comprising a melter gasifier having supply and discharge ducts for adding carbon-containing material, iron-containing reduced fine-particulate material, for withdrawing the generated reducing gas and for feeding oxygen, and further comprising a tap for slag and iron-melt is characterized in that a lower section of the melter gasifier serves for collecting the molten pig iron and the liquid slag and a superimposed central section for accommodating a fixed bed of solid carbon carriers and subsequently an upper section for accommodating a fluidized bed and that a calming space is provided thereabove, that at the level of the fluidized bed at least one mouth of a conveying duct for fine-particulate reduced material is provided in the side wall of the melter gasifier and that an oxygen supply duct penetrates the conveying duct for the fine-particulate reduced material centrally, forming a ring-shaped conveying space for the fine-particulate reduced material, and runs into the melter gasifier.

Preferably, a fluidizing gas for the fine-particulate reduced material can be admitted to the conveying duct.

To enhance the effectiveness of melting the reduced material within the fluidized bed it is advantageous if, in addition, there projects into the melter gasifier an oxygen supply lance whose outlet opening for the oxygen assumes a position at the level of the fluidized bed and central with respect to the cross-section.

To maintain the difference in pressure between the feeding of the fine-particulate reduced material and the melter gasifier, the conveying duct for the fine-particulate reduced material suitably runs to the melter gasifier via a fluidized bed sluice.

Advantageously, a duct supplying a conveying gas for the fine-particulate reduced material runs into the fluidized bed sluice.

BRIEF DESCRIPTION OF THE DRAWINGS

In the appended drawings, each of FIGS. 1 and 2 schematically illustrate a melter gasifier in vertical section.

DESCRIPTION OF PREFERRED EMBODIMENTS

Figure 1:
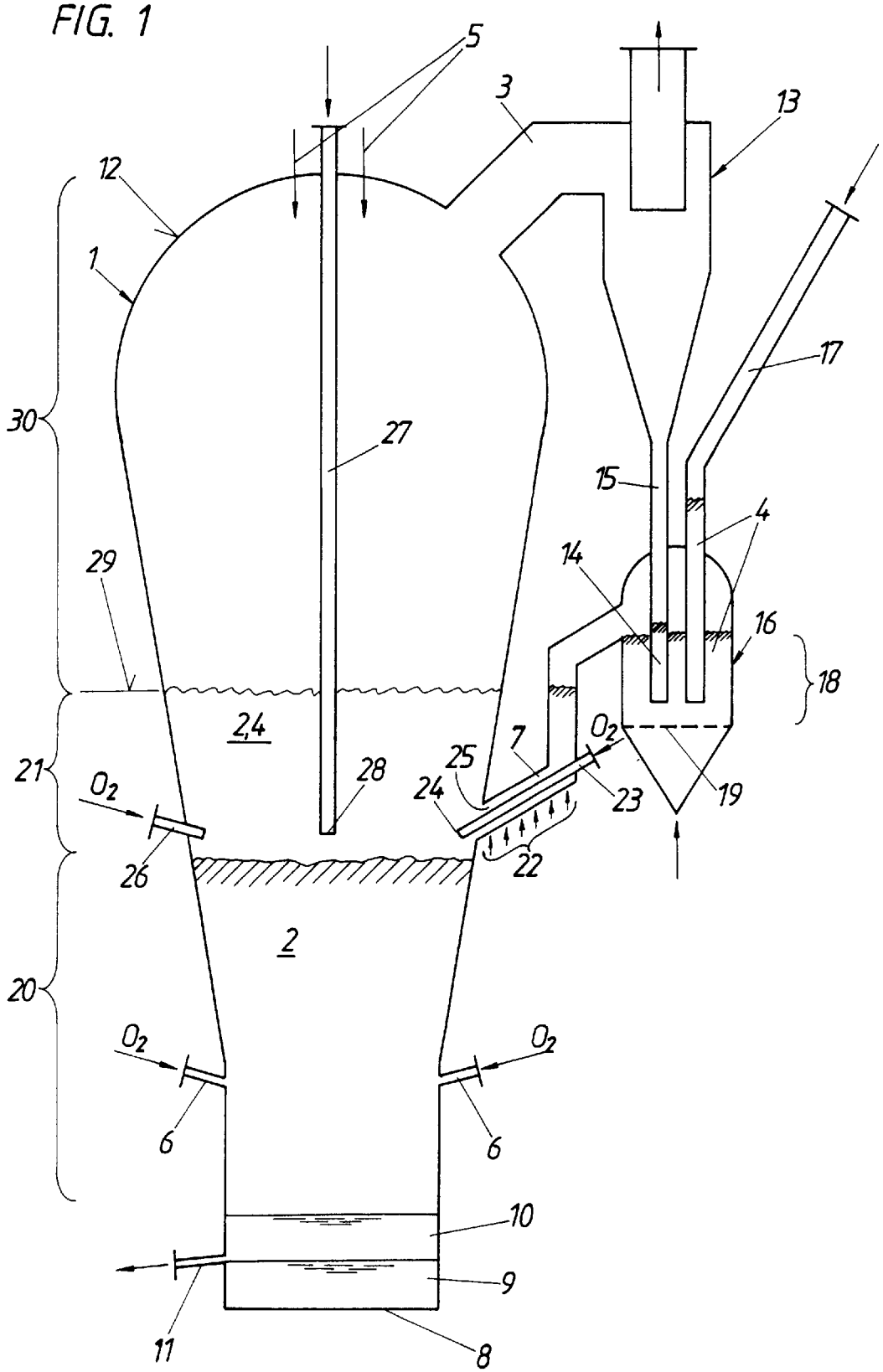

In a melter gasifier 1, a reducing gas is generated from solid carbon-containing material 2, such as coal, and from oxygen-containing gas by gasifying the coal 2, which reducing gas through a discharge duct 3 is conducted to a fluidized bed reactor (not illustrated in detail) in which fine ore is reduced to sponge iron 4. The melter gasifier 1 is provided with a feed duct 5 for the solid carbon carriers 2, a feed duct 6 for oxygen-containing gases, a feed duct 7 for sponge iron as well as optionally feed ducts for carbon carriers, such as hydrocarbons, that are liquid or gaseous at room temperature and for burnt fluxes. In the melter gasifier 1 molten pig iron 9 and molten slag 10 collect in the bottom area 8, which are tapped off through a tap 11.

The iron ore that has been reduced to sponge iron 4 in the fluidized bed reactor is discharged from the fluidized bed reactor—optionally together with burnt fluxes—via a conveying means, for example by means of discharge worms, and is fed to the melter gasifier 1. Both the feed duct 5 for the solid carbon carriers 2 and the discharge duct 3 for the reducing gas, namely a plurality of each, are provided in the dome area 12 of the melter gasifier 1 in a roughly radially symmetrical arrangement.

The discharge duct 3 opens into a solids separator 13 constructed as a hot cyclone. In this hot cyclone 13 the fine particles 14 entrained by the reducing gas, such as coal and sponge iron, are separated and via a downpipe 15 are introduced into a fluidized bed sluice 16. Into this fluidized bed sluice 16 there enters a feed duct 17 for reduced fine-particulate material, namely for the sponge iron 4 that is formed from fine ore and that is withdrawn from the fluidized bed reactor.

The fluidized bed 18 formed in the fluidized bed sluice 16 from the lower reaches of the hot cyclone and the supplied fine-particulate sponge iron 4 is maintained by means of a fluidizing gas supplied to the fluidized bed sluice 16 via a tuyere bottom 19.

From the fluidized bed sluice 16 the feed duct 7 for the sponge iron 4 leads into the melter gasifier 1 at the height-level of the fluidized bed 21 formed in the melter gasifier 1 above a fixed bed 20 of carbon-containing material. This fluidized bed 21 is formed of fine-particulate carbon-containing material 2 and sponge iron 4. The carrier gas for maintaining the fluidized bed 21 is formed by the reducing gas exiting the fixed bed 20, which reducing gas is generated by the gasification of the carbon-containing material 2.

To the feed duct 7 constructed as a conveying duct for the sponge iron 4, a fluidizing gas is admitted at least in the outlet area 22, which gas conveys the sponge iron 4 into the melter gasifier 1. At a central position inside the conveying duct 7 and coaxial therewith an oxygen feed duct 23 is provided whose outlet 24 projects into the melter gasifier 1 to just beyond the ring-shaped outlet 25 of the conveying duct 7. The oxygen jet fed in through the oxygen feed duct 23 is peripherally surrounded, i.e. enclosed, by the supplied sponge iron 4. As a consequence, melting of the sponge iron 4 will occur directly in the fluidized bed 21 on account of the high temperature that adjusts.

Preferably, several fluidized bed sluices 16 are disposed around the melter gasifier 1 in a distributed arrangement, whereby feeding of the sponge iron 4 will be radially symmetrical and will be uniform throughout the cross-section of the melter gasifier 1. Between the outlets 25 of the sponge-iron conveying ducts 7 still further oxygen feed ducts 26 may, in addition, open into the melter gasifier 1, which further enhance the effectiveness of the melting operation. To also utilize the center of the fluidized bed 21 as a melting zone there is provided an oxygen lance 27 whose outlet 28 is provided to be located approximately in the center and closely above the fixed bed 20 in the fluidized bed 21. The oxygen lance 27 suitably is arranged so as to project into the melter gasifier 1 centrally from above.

The total height 29 of the fixed bed 20 and the fluidized bed 21 is adjusted such that a reducing gas temperature of about 1050° C. will adjust in the calming space 30 provided above the fluidized bed 21. The position of the fixed-bed surface can be influenced by the choice of the grain size of the coal which is being supplied and/or by the distribution of the total oxygen content among the fixed bed 20 and the fluidized bed 21.

Figure 2:
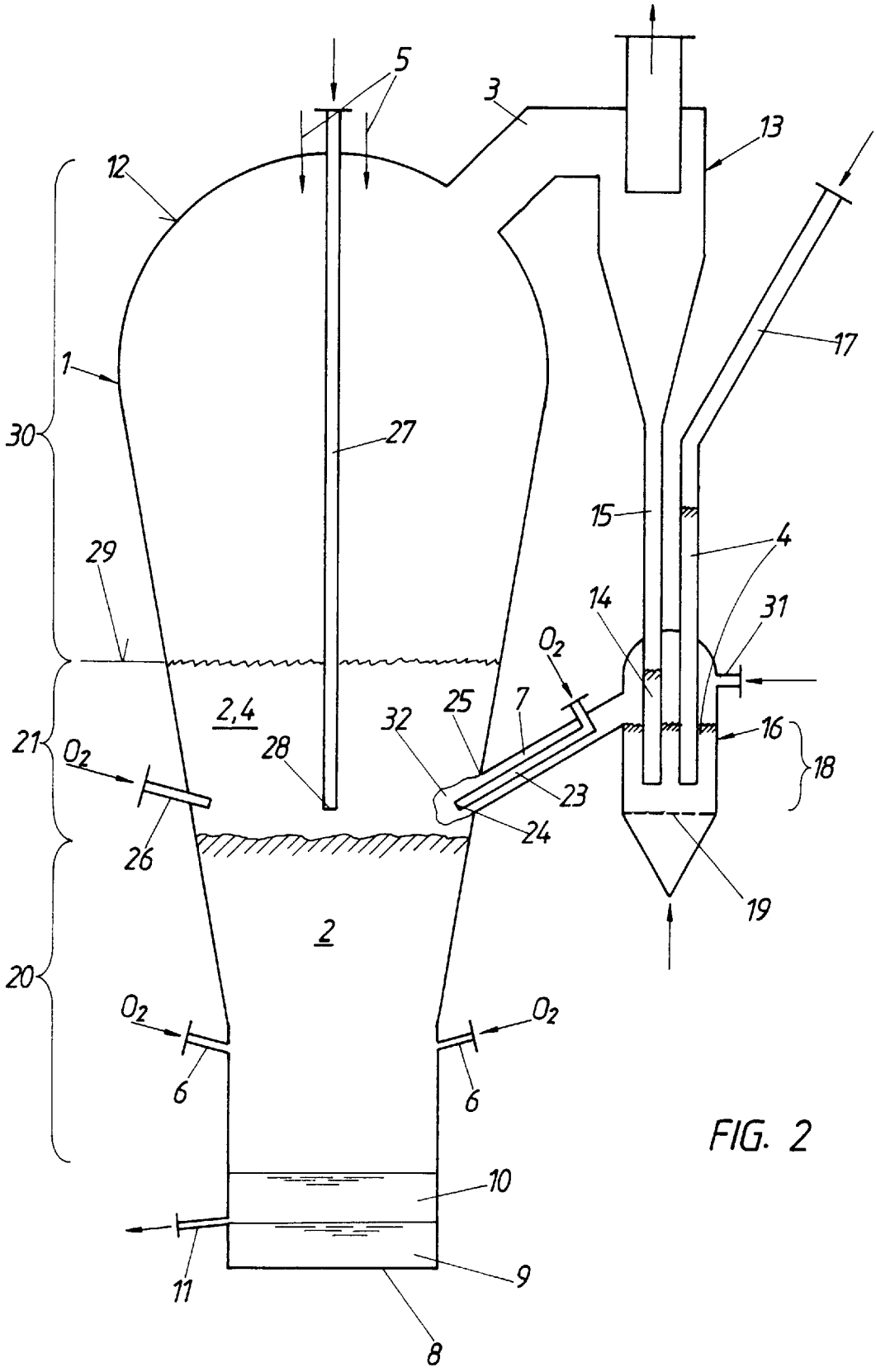

According to the embodiment represented in FIG. 2, feeding is effected into the upper portion of the fluidized bed sluice 16 via a duct 31 by means of a conveying gas formed f i. of cooled reducing gas, and in an amount such that at the outlet 25 a hollow space 32 will form in the fluidized bed 21 on account of the impulse of the entering gas.

The invention is not limited to the embodiments represented in the drawing but may be modified in various respects. There is f.i. no need for the oxygen feed duct 23 to be provided coaxially inside the feed duct 7. What is essential is that there be contact with oxygen directly after the sponge iron 4 has entered the melter gasifier 1, so that the melting process of the sponge iron 4 can take place entirely in the fluidized bed 21. To achieve this, the feed duct 7 and the oxygen feed duct 23 could be arranged so as to be immediately adjacent, although the best result is attained if the sponge iron 4 encloses the oxygen jet at least in the region of the outlet 25.

What is claimed is:

1. A plant for producing liquid pig iron (9) or steel pre-products from fine-particulate reduced iron-containing material (4), comprising a melter gasifier (1) having supply and discharge ducts (3, 5, 6, 7) for adding carbon-containing material (2), iron-containing reduced fine-particulate material (4), for withdrawing the generated reducing gas and for feeding oxygen, and further comprising a tap (11) for slag and iron-melt, characterized in that a lower section (8) of the melter gasifier (1) serves for collecting the molten pig iron (9) and the liquid slag (10) and a superimposed central section for accommodating a fixed bed (20) of solid carbon carriers and subsequently an upper section for accommodating a fluidized bed (21) and that a calming space is provided there above, that at the level of the fluidized bed (21) at least one mouth of a conveying duct (7) for fine-particulate reduced material (4) is provided in the side wall of the melter gasifier (1) and that an oxygen supply duct (23) is provided in immediate proximity to the conveying duct (7) for fine-particulate reduced material (4), wherein said conveying duct (7) runs to the melter gasifier via a fluidized bed sluice, and that a duct (31) supplying a conveying gas for the fine-particulate reduced material (4) runs into the fluidized bed sluice (16).

2. A plant according to claim 1, characterized in that to the conveying duct (7) for the fine-particulate reduced material (4) a fluidizing gas can be admitted.

3. A plant according to claim 1, characterized in that, in addition, there projects into the melter gasifier (1) an oxygen supply lance (27) whose outlet opening (28) for the oxygen assumes a position at the level of the fluidized bed (21) and central with respect to the cross-section.

4. A method for producing liquid pig iron (9) or steel pre-products from fine-particulate iron-containing material (4) in a melter gasifier (1) in which under supply of carbon-containing material (2) and oxygen at the simultaneous formation of a reducing gas the iron-containing material (4) is melted in a bed (20, 21) formed from solid carbon carriers (2), upon previous complete reduction, wherein the fine-particulate reduced material (4) and oxygen are introduced into the bed (20, 21) from the side, characterized in that above a fixed bed (20) formed of solid carbon carriers (2) a fluidized bed (21) of fine-particulate solid carbon carriers (2) and fine-particulate iron-containing reduced material (4) is maintained and the fine-particulate reduced material (4) is charged into the fluidized bed (21) directly, in immediate contact with oxygen and that the fine-particulate reduced material (4) is melted in the fluidized bed, wherein the fine-particulate reduced material (4) prior to being charged into the fluidized bed (21) is collected in a vessel (16) under formation of a fluidized bed (18), the vessel thereby forming a fluidized bed sluice, and out of the fluidized bed (18) is conveyed onward into the fluidized bed (21) by a conveying and/or fluidizing gas;

and the reducing gas formed together with fine-particulate material carried thereby is discharged from the melter gasifier via a cyclone separator and the fine-particulate material separated therein is fed into the melter gasifier by means of said fluidized bed sluice, together with the fine-particulate reduced material.

5. A method according to claim 4, characterized in that the fine-particulate reduced material (4) is charged into the fluidized bed (21) by means of a fluidized gas.

6. A method according to claim 5, wherein the fluidized gas is blown into the fluidized bed.

7. A method according to claim 4, characterized in that oxygen is additionally blown into the fluidized bed (21) in the central region of the same.

8. A method according to claim 7, wherein the oxygen is blown into the fluidized bed (21) from above.

9. A method according to claim 4, characterized in that the fine-particulate reduced material (4) is blown into the fluidized bed (21) under pressure by means of a conveying gas, such that at the outlet into the fluidized bed (21) there forms a hollow space (32) which is free for the fine-particulate reduced material (4).

10. A method according to claim 9, characterized in that into the fluidized bed (18) a conveying gas for the fine-particulate reduced material (4) is fed under pressure.

11. A method according to claim 10, wherein said conveying gas is fed into the fluidized bed (18) under a pressure exceeding the pressure that prevails in the fluidized bed (21).

* * * * *

UNITED STATES PATENT AND TRADEMARK OFFICE

CERTIFICATE OF CORRECTION

PATENT NO. : 6,454,833 B1
DATED : September 24, 2002
INVENTOR(S) : Michael Nagl et al.

It is certified that error appears in the above-identified patent and that said Letters Patent is hereby corrected as shown below:

Title page,
Item [73], should read:

-- [73] Assignee: Voest-Alpine Industrieanlagenbau GmbH (AT)
Pohang Iron & Steel Co., Ltd. (KR)
Research Institute of Industrial Science & Technology Incorporated Foundation (KR) --

Signed and Sealed this

Seventeenth Day of December, 2002

JAMES E. ROGAN
*Director of the United States Patent and Trademark Office*